US010465570B1

(12) United States Patent
Barber

(10) Patent No.: US 10,465,570 B1
(45) Date of Patent: Nov. 5, 2019

(54) VERTICAL SLIDING VALVE ARM

(71) Applicant: Michael D. Barber, Loma Linda, CA (US)

(72) Inventor: Michael D. Barber, Loma Linda, CA (US)

( * ) Notice: Subject to any disclaimer, the term of this patent is extended or adjusted under 35 U.S.C. 154(b) by 276 days.

(21) Appl. No.: 15/731,275

(22) Filed: May 16, 2017

(51) Int. Cl.
*F01L 1/46* (2006.01)
*F01L 1/14* (2006.01)
*F01L 1/047* (2006.01)

(52) U.S. Cl.
CPC ..... *F01L 1/462* (2013.01); *F01L 1/047* (2013.01); *F01L 1/146* (2013.01); *F01L 1/465* (2013.01)

(58) Field of Classification Search
CPC . F01L 1/047; F01L 1/146; F01L 1/462; F01L 5/045; F01L 7/02
See application file for complete search history.

(56) References Cited

U.S. PATENT DOCUMENTS 1,309,339 A * 7/1919 Reynolds ..... F01L 1/16 123/90.25
4,308,828 A * 1/1982 Kinsel ..... F01L 1/46 123/90.24
6,234,126 B1 * 5/2001 Kaye ..... F01L 1/00 123/65 VD
7,146,948 B1 * 12/2006 Eells ..... F01L 1/042 123/90.24
7,603,971 B2 * 10/2009 Allen ..... F01L 13/0021 123/90.16
8,033,261 B1 10/2011 Robbins

* cited by examiner

*Primary Examiner* — Ryan A Reis
(74) *Attorney, Agent, or Firm* — Kirk A. Buhler; Buhler & Associates Patenting

(57) ABSTRACT

Systems and methods related to eliminating the common pivot-type rocker arm and reversing the use of the valve spring in internal combustion engines. More specifically, the camshaft lobes activate a sliding valve arm to close the engine valve instead of opening it and the valve spring is used to push open the valve instead of closing it.

14 Claims, 7 Drawing Sheets

VERTICAL SLIDING VALVE ARM

CROSS REFERENCE TO RELATED APPLICATIONS

This application claims priority to U.S. Provisional Application having Ser. No. 62/391,072 filed Apr. 18, 2016, and application having Ser. No. 62/391,982 filed May 16, 2016, which is hereby incorporated by reference in its entirety.

STATEMENT REGARDING FEDERALLY SPONSORED RESEARCH OR DEVELOPMENT

Not applicable.

BACKGROUND

The current way to close an engine valve is to use a spring. This is not desirable because of the dynamic motion in engines, which may cause spring wear and various valve train problems that lead to poor power transmission and poor fuel consumption rates. Valve float is one of the valve train problems and refers to the inability of the valve lifter to properly follow the contour of the camshaft when the engine is operating at high speeds. Since the valve actuation is not aligned with the shape of the camshaft lobe, this may result in catastrophic failure or engine damage if the closing valve makes contact with the piston. The other consequences are valve spring harmonics and vibrations that cause the valve to bounce on its seat while trying to open and close. Pivoting rocker arm and valve spring failure is another common malady in high-performance racing engines. Therefore, it is advantageous to employ engine valve actuation that does not require pivoting rocker arms and valve springs for valve closure.

This present invention eliminates or minimizes these problems by using the camshaft lobe at its peak to close the engine valve with positive linkage through the pushrod. Valve float is minimized along with the chance of a piston hitting the engine valve as a result of an engine valve staying open for too long due to weak or malfunctioning valve springs. Another benefit of this invention is more precise valve timing events with custom ground camshafts that are designed to close the valve at its peak more aggressively. Additionally, more radical grinds can be used. As a result of more precise valve timing and smaller valve spring pressure, fuel consumption efficiency in terms of gas mileage is improved.

This present invention uses a vertical sliding valve arm that is activated by the camshaft to close an engine valve and a valve spring to open the valve. This is in contrast to conventional engines, which use the camshaft lobes to open a valve and the valve spring to close it. The invention reverses the function of the valve spring, uses the camshaft lobes to activate a sliding valve arm with the attached engine valves, and uses the valve spring to open the engine valves at the appropriate time. The invention comprises in part a retrofitting system requiring little machine work on an existing engine.

TECHNICAL FIELD

The present invention relates to valve actuation methods in internal combustion engines. More specifically, the present invention relates to valve actuation systems that do not rely on rocker arms or valve springs to close the engine valves.

DESCRIPTION OF RELATED ART

An internal combustion engine typically relies on poppet-type intake and exhaust valves to feed a combustible mixture of air and fuel into a cylinder, seal the cylinder during combustion, and then expel burned fuel and air mixtures. A valve train is composed of valves and a camshaft to first actuate the valve opening and then closing it. A camshaft is a shaft with attached ellipsoidal lobes that when rotated, actuate a pivoted rocker arm to push down on the corresponding valves, thereby opening a valve to allow an air and fuel mixture into a cylinder. Springs located at the cylinder head are commonly used to then close the valve to a closed resting position.

Using a spring to close a valve is not desirable because of the dynamic motion in engines, typically involving high revolutions per minute (rpm). This can cause spring wear and valve float that results in poor power transmission and poor fuel consumption rates. Valve float refers to a scenario where the valve actuation is not aligned with the shape of the camshaft lobe and may result in catastrophic failure if the closing valve makes contact with the piston. Pivoting rocker arm and valve spring failure is another common malady in high-performance racing engines. Therefore, it is advantageous to employ valve actuation that does not require pivoting rocker arms and valve springs for valve closure.

One approach is to use springless valves known as desmodromic valves. Desmodromic valve systems use extra cam lobes on the camshaft to close the valves via pivoting rocker arms. Springs are thereby eliminated and the potential for valve float or broken springs is removed. However, desmodromic valves are costly, labor-intensive, and difficult to mass produce.

One such desmodromic design is U.S. Pat. No. 8,033,261. The lifter in this patent provides additional support and is offset. This requires the lifter for the rocker arm to be at a 90-degree angle, which in turn requires extensive modification to an existing cylinder block to position the lifter at a 90-degree angle to the camshaft. The intermediate rocker is caused to oscillate on its free-turning support shaft.

The present invention uses a vertical sliding valve arm activated by the camshaft to close the corresponding valve and a valve spring to open the valve. This is in contrast to conventional engines, which use the camshaft lobes to open a valve and the valve spring to close it. The present invention comprises in part a retrofitting system requiring little machine work on an existing engine.

SUMMARY OF INVENTION

The present invention relates to cylinder valve actuation occurring within internal combustion engines or motors whereby valve springs and pivot rocker arms are the standard for causing, in part, cylinder valve closing. The present invention eliminates the common pivot-type rocker arm and reverses the use of the valve spring whereas the camshaft lobes activate a sliding valve arm to close the engine valve instead of opening it and the valve spring is used to push open the valve instead of closing it.

It is therefore an object of the present invention to eliminate the conventional pivot rocker arm to achieve valve actuation and relatedly, to eliminate the problems associated with valve float in high rpm motors.

It is another object of the present invention to reduce or eliminate stress valve train components.

It is another object of the present invention to reduce friction on engine components.

It is another object of the present invention to improve fuel consumption rates.

It is another object of the present invention to decrease the reciprocation weight off the camshaft and drive gears, and valve train.

It is another object of the present invention to decrease valve spring pressures resulting in less wear on engine components.

It is another object of the present invention to use more precise valve timing on the camshaft lobe profiles.

It is another object of the present invention to reduce or eliminate valve train parts breakage due to valve float.

It is another object of the present invention to introduce a new camshaft profile that will upon it, apex or peak close the engine valves instead of opening them.

The characteristics and utilities of the present invention described in this summary and the detailed description below are not all inclusive. Many additional features and advantages will be apparent to one of ordinary skill in the art given the following detailed description.

There has thus been outlined, rather broadly, the more important features of the invention in order that the detailed description thereof that follows may be better understood, and in order that the present contribution to the art may be better appreciated.

In this respect, by explaining at least one embodiment of the invention in detail, it is to be understood that the invention is not limited in its application to the details of construction and to the arrangements of the components set forth in the description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may be utilized as a basis for the design of other structures, methods, and systems for carrying out the purposes of the present invention. It is important, therefore, that the description be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers, and practitioners who are not familiar with patent or legal terms or phraseology, to determine quickly from a cursory inspection, the nature and essence of the technical disclosure of the application. The abstract is neither intended to define the invention of the application, nor is it intended to be limiting as to the scope of the invention in any way.

DETAILED DESCRIPTION

Figure 1:
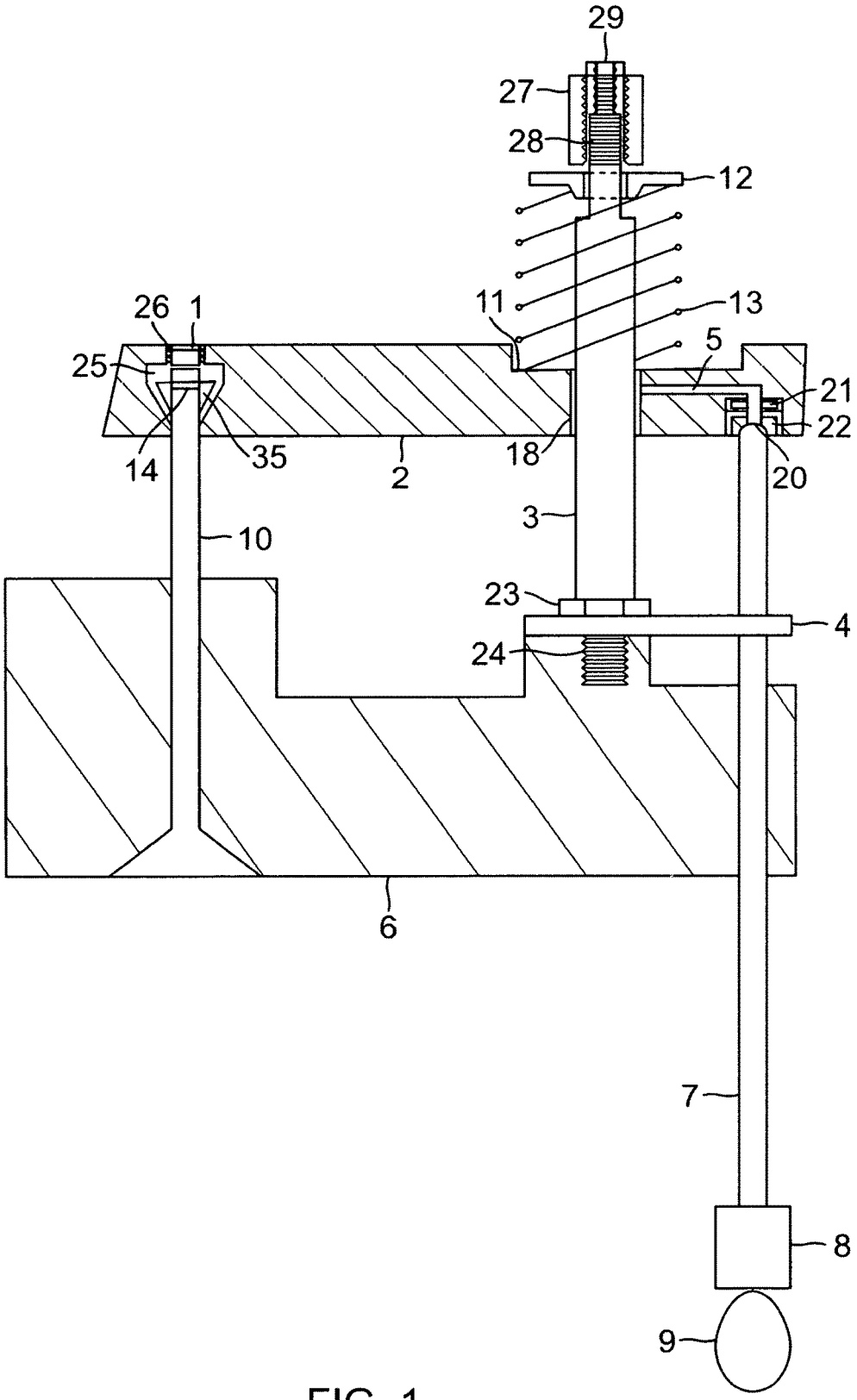
FIG. 1 shows the sliding arm with the valve spring mounted above the sliding arm.

The present invention uses a vertical sliding valve arm activated by the camshaft to close an engine valve and a valve spring to open the valve. In one non-limiting example, the invention may be configured as illustrated in FIG. 1, which shows the preferred embodiment with the sliding arm mounted on the cylinder head 6 with a conventional-type valve spring 13 located above the sliding arm 2. The spring is held in place by a valve retainer 12. This retainer is held in place by body and housing 2, which is attached to threaded stem 28 of sliding post 3. The operation is described as follows. As camshaft 9 turns, it pushes up on lifter 8 and also pushes up on pushrod 7 that is guided by a pushrod guide plate 4. The end of pushrod 7 fits into the socket of pushrod piston 20, which slides in bore 22. As the pushrod rises, pushrod piston 20 contacts compressible material 21, which can be a compressible material such as rubber. Its purpose is to dampen the closing of the engine valve 10 as it closes on its seat in cylinder head 6. It also serves to dampen the camshaft lift and provide temporary dwell to aid in the camshaft duration.

Sliding arm 2 is connected to valve 10 by valve locks 35 housed in cavity 25 of sliding arm 2. Therefore, as sliding arm 2 rises, it closes valve 10 and compresses valve spring 13. As the camshaft continues to rotate, it moves to the base or the lowest point of its lobe, allowing pushrod 7 to lower and allowing the compressed valve spring 13 to uncompress, pushing down on the sliding arm 2 and lowering the attached valve 10 to an open position. As the camshaft continues to rotate, it repeats the cycle again. The engine's oil passing through the pushrod flows through passage 5 to lubricate the bushing 18 on the sliding arm post 3. This arrangement makes it practically impossible to float engine valves at high rpm, and impossible for the valve to strike and damage the engine pistons as a result of the valve float. Thus, the spring no longer closes the valve the way it does in a conventional-type valve train engine. Instead, it is closed through the positive force of the pushrod to the sliding arm in this invention.

Figure 2:
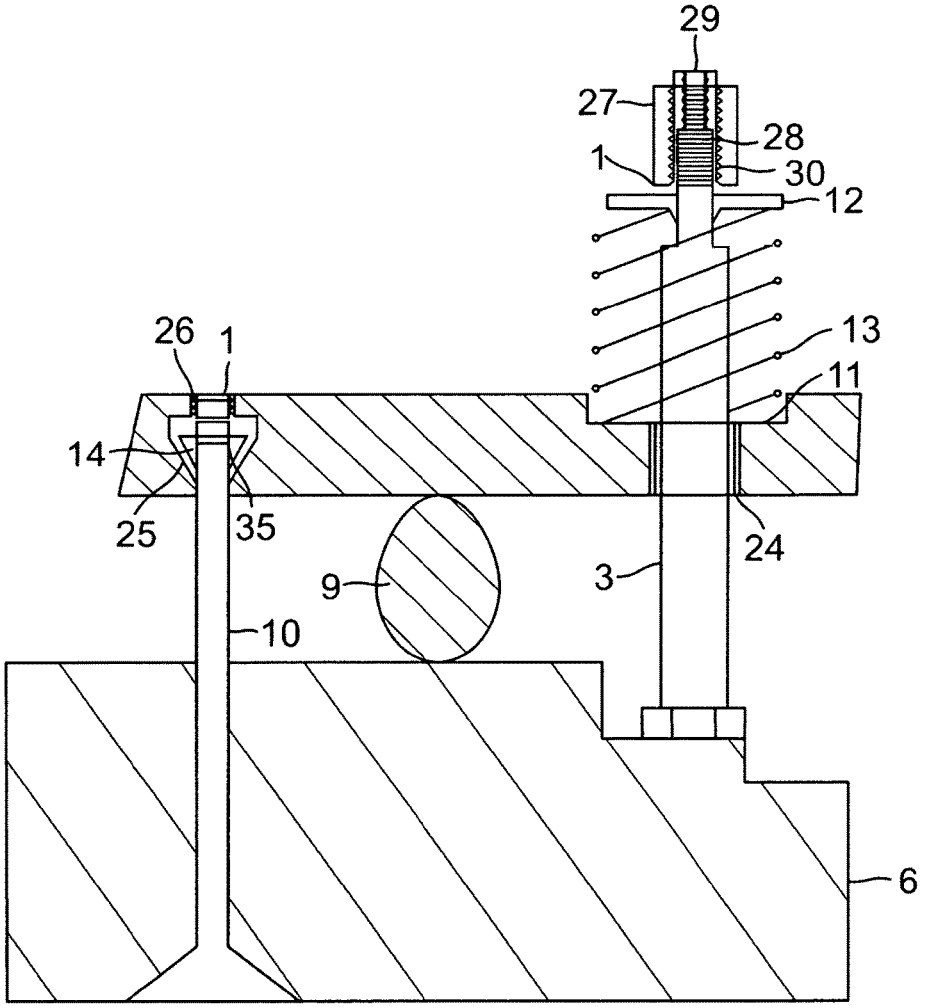
FIG. 2 shows the sliding arm in a overhead cam configuration.

FIG. 2 shows an alternative method of the embodiment. The slider on an overhead valve type engine operates as follows. As camshaft 9 turns, it lobes contacts and pushes up sliding arm 2. At the same time, it pushes up attached valve 10 that is attached by valve locks 35 and housed in cavity 25 of sliding arm 2. Therefore, as the sliding arm rises, it closes valve 10 and compresses valve spring 13. As the camshaft continues to rotate, it moves to the base or the lowest point of its lobe, allowing the sliding arm 2 to lower and allowing the compressed valve spring 13 to uncompress, pushing down on sliding arm 2 and lowering the attached valve 10 to an open position. As the camshaft continues to rotate, it repeats the cycle again.

Figure 3:
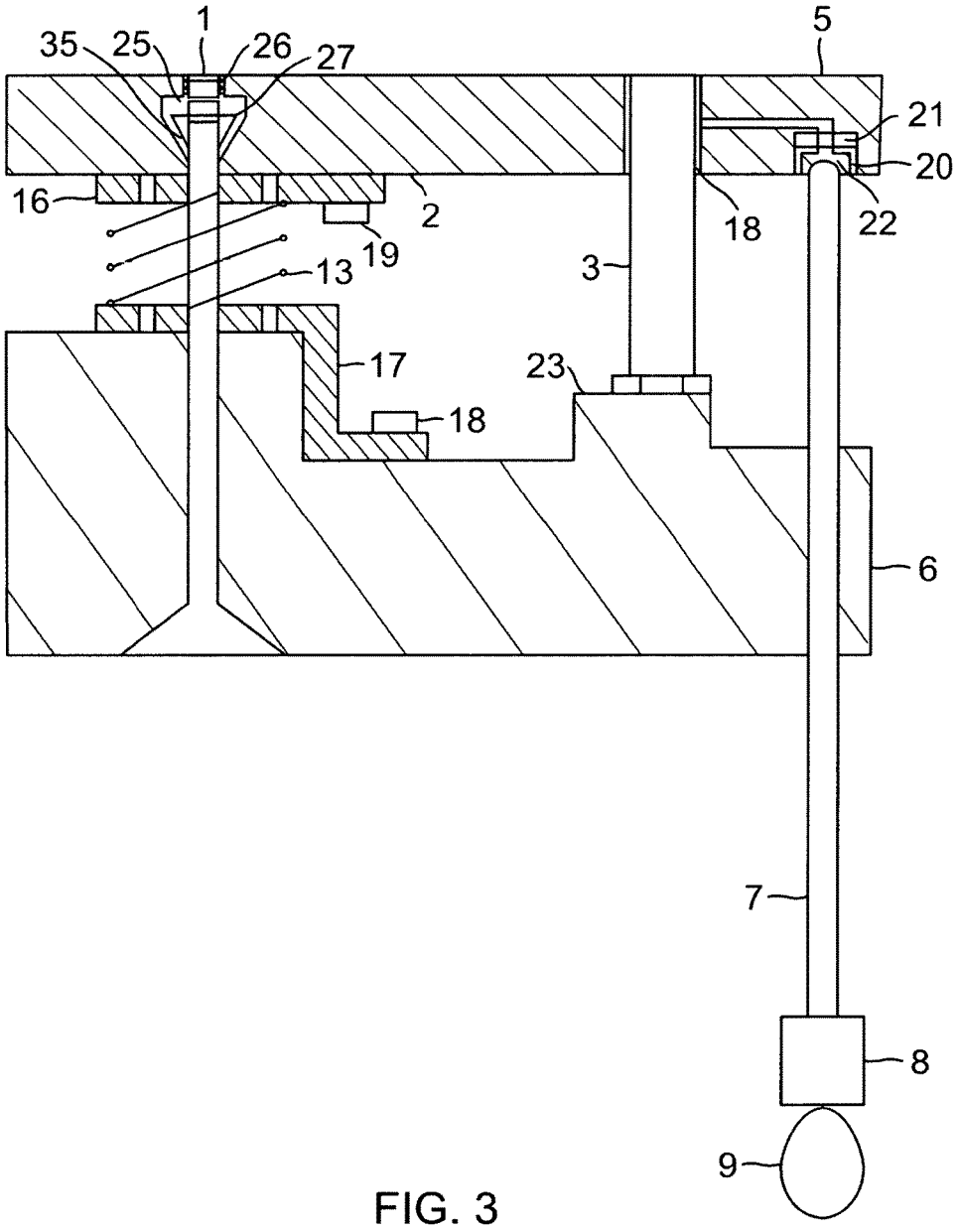
FIG. 3 shows the sliding arm with a valve spring mounted below the sliding arm when used in a valve spring expansion type configuration.

FIG. 3 shows an alternative method of the embodiment. It is a variation of FIG. 1 with the valve spring mounted below the sliding arm when used in a spring expansion arrangement. The operation is described as follows. As camshaft 9 turns, it pushes up lifter 8 and also pushes up on pushrod 7. The end of pushrod 7 fits into the socket of pushrod piston 20, which slides in bore 22. As the pushrod rises, pushrod piston 20 contacts compressible material 21, such as rubber. Its purpose is to dampen the closing of the engine valve 10.

As it closes on its seat in cylinder head 6, it also serves to dampen the camshaft lift and provide temporary dwell to aid in the camshaft duration.

Sliding arm 2 is connected to valve 10 by valves locks 35 housed in cavity 25 of sliding arm 2. Therefore, as the sliding arm rises, it closes valve 10 and expands valve spring 13. As the camshaft continues to rotate, it moves to the base or the lowest point of its lobe, allowing pushrod 7 to lower and allowing the compressed spring 13 to retract, pulling down on the sliding arm 2 and lowering the attached valve 10 to an open position. As the camshaft continues to rotate it, repeats the cycle again. The engine's oil passing through the pushrod via the valve lifter flows through passage 5 and into bushing 18 to lubricate it. This arrangement makes it practically impossible to "float" at high engine rpm, and impossible for the valve to strike and damage the engines pistons. "Valve float" or valves staying open for too long due to valve spring oscillations or weak valve spring function. Because the valves are no longer opened by the camshaft and closed by the valve springs as in a conventional engine, valve float is avoided. Instead, the valves with this invention are closed by the positive force of the pushrod to the sliding arm.

Figure 4:
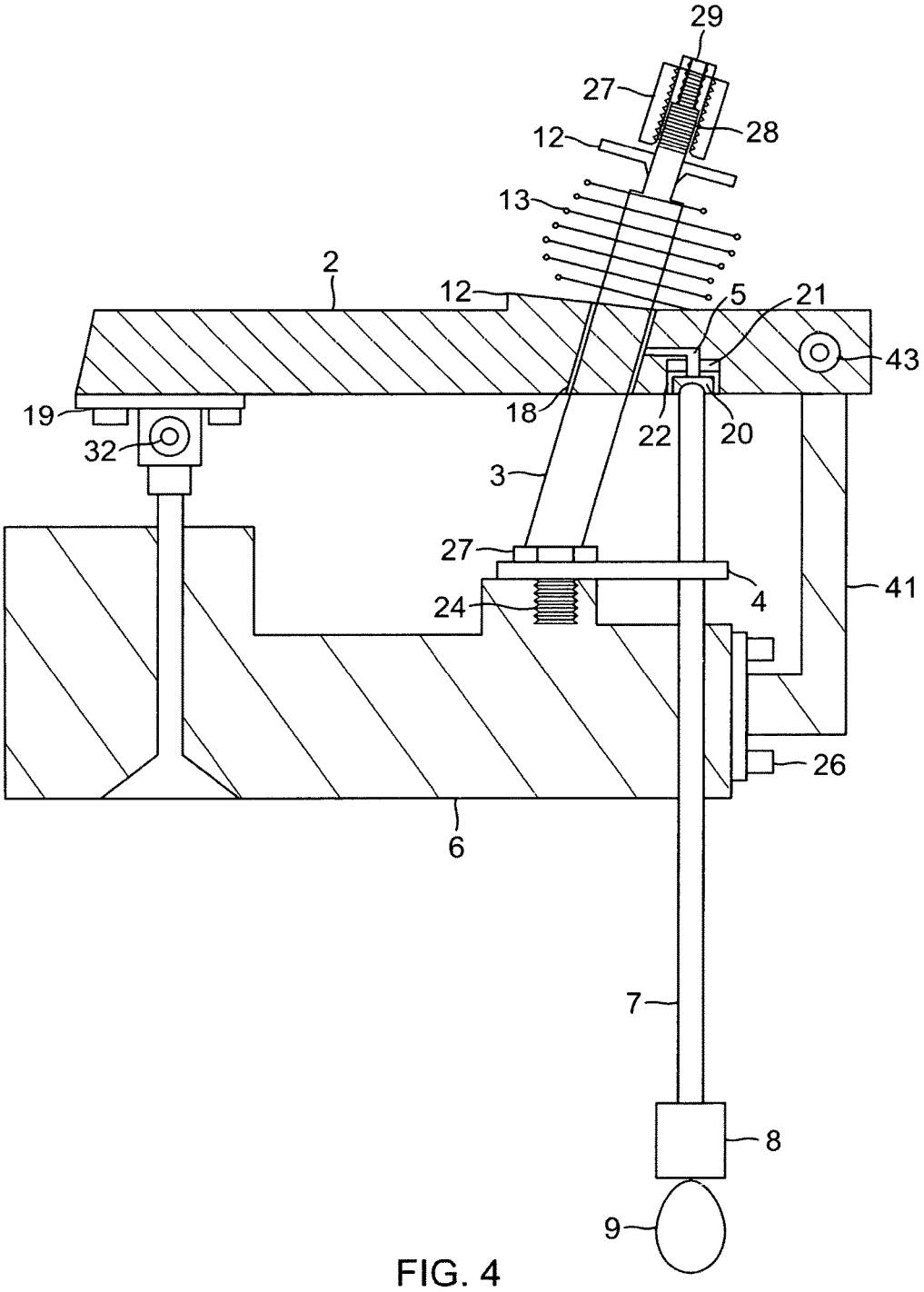
FIG. 4 illustrates a pivoting arm with the valve spring mounted on top.

FIG. 4 illustrates a pivoting lever type arm and operates as follows. As camshaft 9 turns, it pushes up lifter 8 and pushes on pushrod 7, which fits into pushrod socket pushrod piston 20. This piston slides in bore 22 as the pushrod rises. Pushrod piston 20 contacts compressible material 21, such as rubber. Its purpose is to dampen the closing of the engine valve 10. As it closes on its seat in cylinder head 6, it also servers to dampen the camshaft lift and provide temporary dwell to aid in the camshaft duration. Sliding arm 2 rises and it is connected to pivot valve holder 31 and it pivots on trunnion 33. This trunnion is held by trunnion adapter 32, which is attached to cylinder head 6 with fasteners 19 of the lever in sliding arm 2.

As the camshaft continues to rotate to the base or the lowest point of its lobe, pushrod 7 starts to descend down and valve spring 13 begins to decompress, forcing pushrod 7 to lower on lifter 8 while also lowering engine valve 10 to an open position in the cylinder head 6. The length between the pushrod contact point of sliding arm 2 and the pivot roller 45 on the pivot arm 2 could be varied. This ratio of leverage can be varied to give a mechanical advantage to the movement engine valve 10, similar to the pivot rocker arm ratios commonly used on engines. As the camshaft continues to rotate, it repeats the above-mentioned cycle again.

Figure 5:
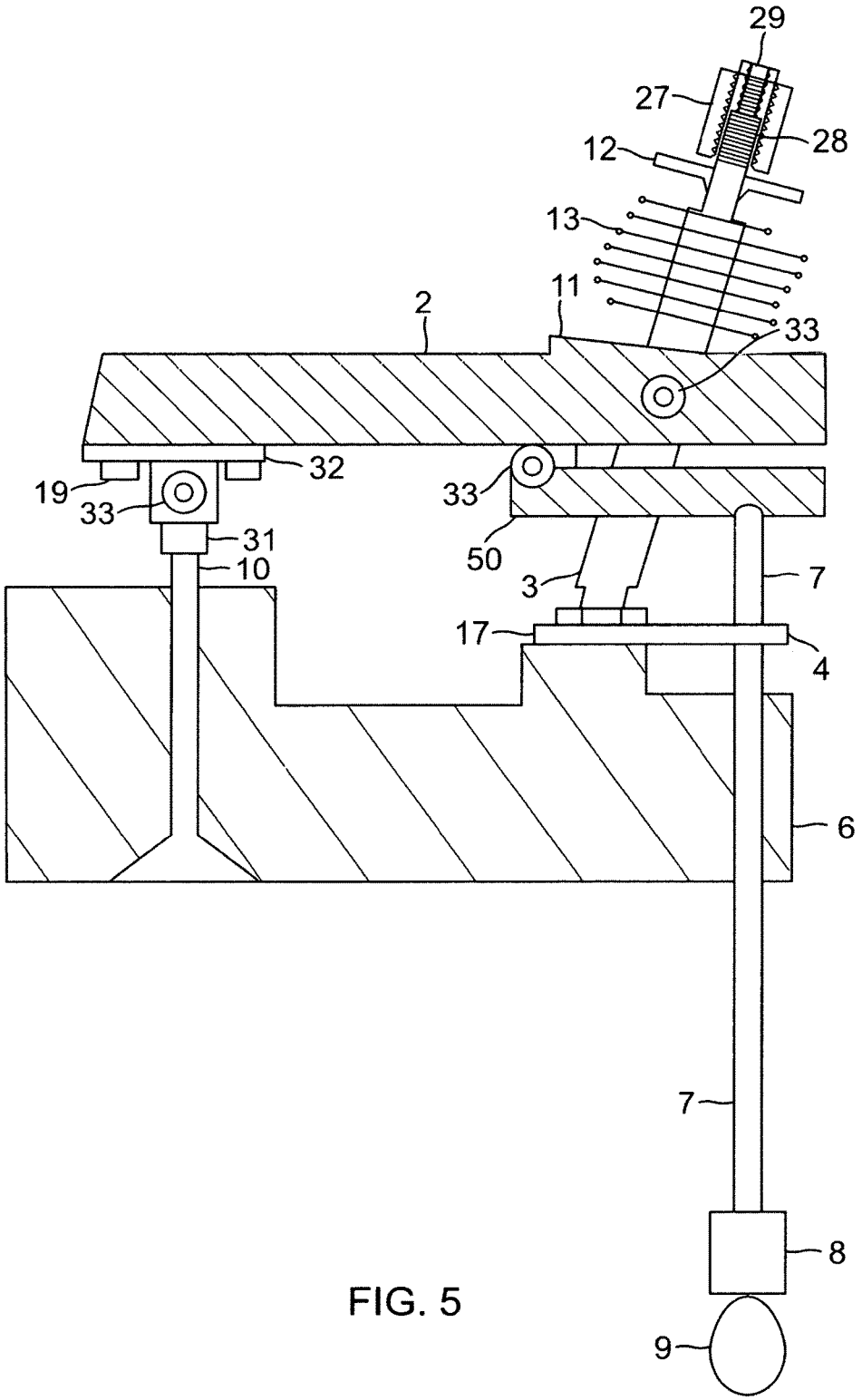
FIG. 5 illustrates a pivoting lever with a sliding roller arm under it.

FIG. 5 illustrates a pivoting lever with a sliding roller arm under it and operates as follows. As camshaft 9 turns, it pushes up lifter 8 while pushing on pushrod 7, which fits into pushrod piston socket 20 of sliding arm roller 50. This causes the pushrod piston to push against the pushrod piston cushion, which is a compressible material such as rubber. As pushrod 7 rises, it lifts roller arm 46, which slides on sliding arm 3, causing the attached pivot roller 45 to contact and lift sliding arm 2, which rises. Sliding arm 2 is attached to pivot roller 45, which is anchored to sliding arm post 3. As the pivot arm pivots moves up, it lifts the attached pivot valve holder 31 and attached valve 10, which is connected through pivot valve holder 31. This holder is held by trunnion adapter 32.

As sliding arm 2 rises, it causes engine valve 10 to close on its seat in cylinder head 6. As the camshaft continues to rotate to the base or the lowest point of its lobe, pushrod 7 starts to descend down and the valve spring 13 begins to decompress, forcing pivot arm 2 and roller slide arm 45 to cause pushrod 7 to lower on lifter 8 while lowering engine valve 10 to an open position in cylinder head 6. The different lengths between the pivot roller 45 and trunnion roller 33 could be varied. This ratio of leverage can be varied to give a mechanical advantage to the amount of lift to engine valve 10, similar to the pivot rocker arm rations commonly used on conventional engines. As the camshaft continues to rotate, the above-mentioned cycle occurs again.

Figure 6:
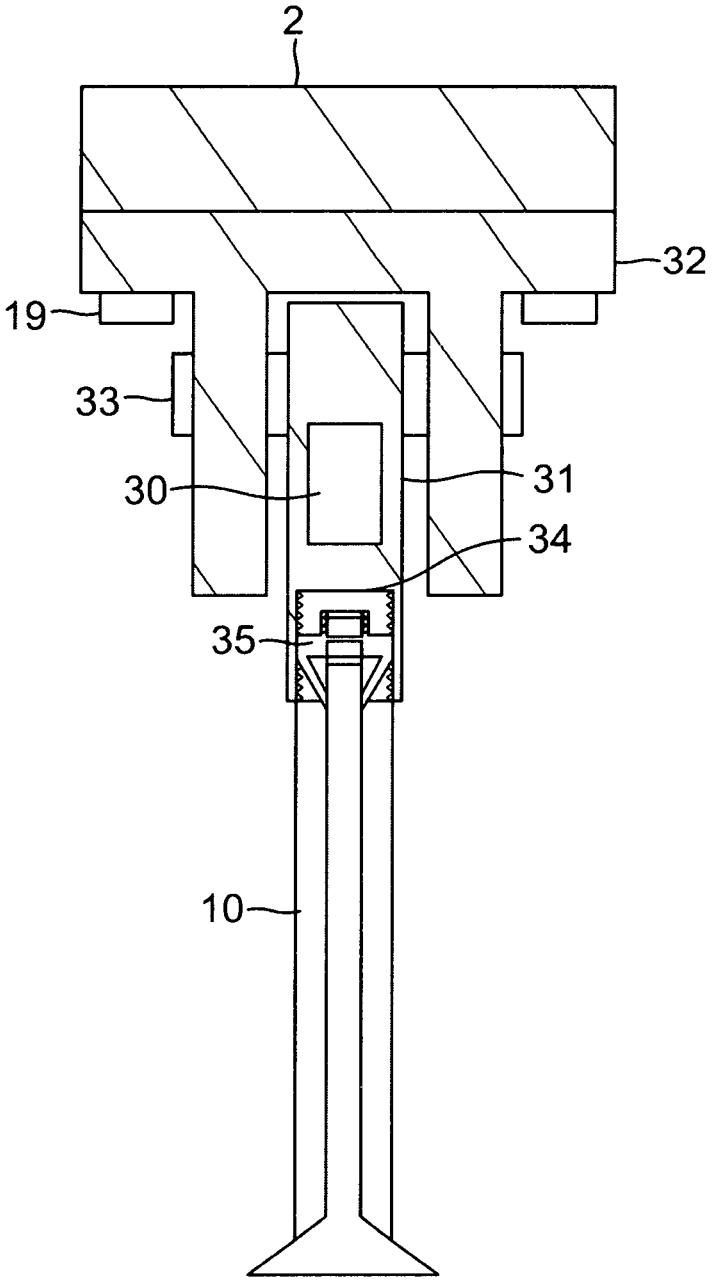
FIG. 6 Illustrates the connection to the engine valve depicted FIGS. 4 and 5.

FIG. 6 illustrates the pivot connection between the valve and sliding arm, which appears on some embodiments in FIG. 4 and FIG. 5 as is described as follows. Sliding arm 2 is attached to pivot valve holder 31, secured by fasteners 19 inside the holder. Valve adapter and trunnion adapter 32 are supported by trunnion bearings 43. The engine valve stem is secured by valve locks 35 housed in pivot valve holder 31, thus creating the ability for pivot of engine valve 10 as sliding arm 2 moves or pivots.

Figure 7:
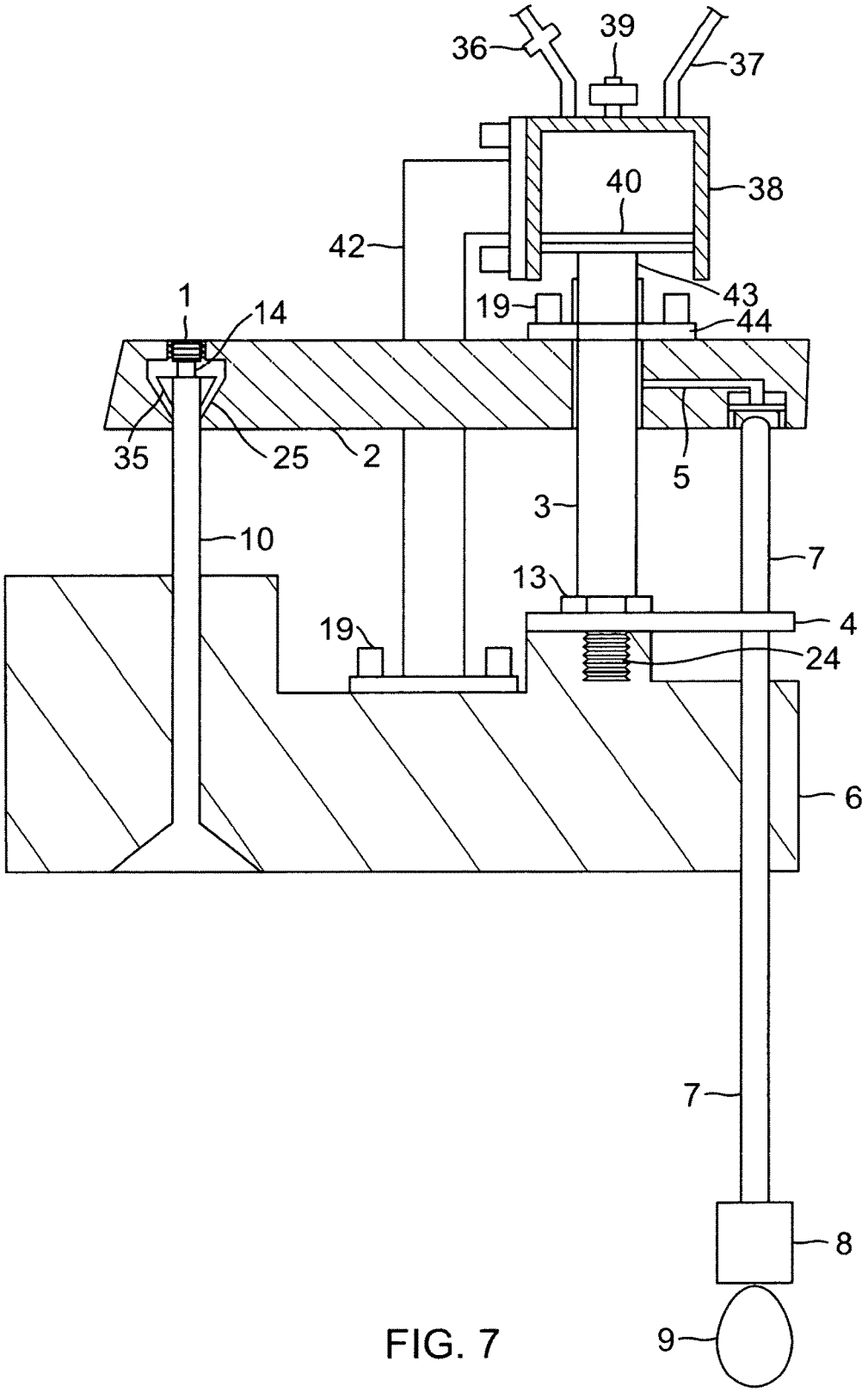
FIG. 7 shows the sliding arm with an air cushion cylinder replacing the valve spring.

FIG. 7 shows the sliding arm with an air cushion cylinder replacing the valve spring depicted in the other embodiments. As camshaft 9 turns, it pushes up lifter 8 while pushing on pushrod 7, which fits into pushrod piston socket 20 of sliding arm roller 50, causing the pushrod piston to push against the pushrod piston cushion, which is a compressible material such as rubber. As the pushrod 7 rises, it lifts piston rod 43, which is attached to sliding arm 2 with fasteners 19. As the piston rod 43 rises, it pushes on piston 40, which is housed in cylinder 38, thereby compressing the air above it to create an air spring. As camshaft 9 continues to rotate to the high point of its lobe, it lifts sliding arm 2 and also lifts valve 10 attached on the other end of sliding arm 2 and is attached to pivot valve holder 31 that is secured by fasteners 19 inside the holder. The valve adapter and trunnion adapter 32 is supported by trunnion bearings 43. The engine valve stem is secured by valve locks 35 and housed in pivot valve holder 31, thus creating the ability for the pivot of engine valve 10 as sliding arm 2 moves.

As sliding arm 2 rises, it lifts attached valve 10 and closes it on its seat in cylinder head 6. As the camshaft continues to rotate, it moves to the low point of its lobe and the lifter 8 descends and pushrod 8 is lowered and compressed air in cylinder 38 begins to decompress, thus putting pressure on piston rod 43. This forces sliding arm 2 down. Pushrod 7 and lifter 8 stay in contact with the lobes on camshaft 9 while the engine valve lowers to the open position in cylinder head 6. The air in the cylinder over time may lose air due to seal leakage so an auxiliary air supply via an air pump may be required for replenishing the air that would enter through supply line 37. Pressure is regulated by regulator/relief valve 39 and air may also be drawn in through supply line 37 and check valve 36.

The foregoing description, for purposes of explanation, has been described with reference to specific embodiments. However, the illustrative discussions above are not intended to be exhaustive or to limit the invention to the precise forms disclosed. Many modifications and variations are possible in view of the above teachings without departing from the spirit and the scope of the description. The embodiments were chosen and described in order to best explain the principles of the invention and its practical applications, to thereby enable others skilled in the art to best utilize the invention and various embodiments with various modifications as are suited to the particular use contemplated. Alternate embodiments are also included within the scope of the disclosure. In these alternate embodiments, functions may be executed out of order from that shown or discussed, including substantially concurrently or in reverse order, depending on the functionality involved. Not all steps are required in all embodiments.

What is claimed is:

1. A system of valve actuation by way of a rotating camshaft comprising:

a rotating cam pushing up on a valve lifter and a pushrod to contact a horizontal sliding arm;

the horizontal sliding arm contacts the pushrod on a first end of the horizontal sliding arm and is lifted by the pushrod;

an engine valve is attached on the other end of the horizontal sliding whereby a rise and a fall of the horizontal sliding arm opens and closes the engine valve;

a valve spring is mounted on top of the horizontal sliding arm between the pushrod and the engine valve such that when the horizontal sliding arm rises, it compresses the valve spring and when the horizontal sliding arm is lowered, the valve spring becomes uncompressed and provides a force to open the engine valve and also provides a second force to keep the valve lifter in contact with the rotating cam via the valve lifter.

2. The system of valve actuation by way of a rotating camshaft according to claim 1, wherein the valve spring is supported on a sliding arm post.

3. The system of valve actuation by way of a rotating camshaft according to claim 2, wherein the sliding arm post is secured into a cylinder head.

4. The system of valve actuation by way of a rotating camshaft according to claim 3, further includes a bushing between the horizontal sliding arm and the sliding arm post.

5. The system of valve actuation by way of a rotating camshaft according to claim 2, wherein the sliding arm post has a threaded stem.

6. The system of valve actuation by way of a rotating camshaft according to claim 5, wherein the threaded stem is configured to allow for compression of the valve spring.

7. The system of valve actuation by way of a rotating camshaft according to claim 1, wherein the horizontal sliding arm includes a bore for the pushrod.

8. The system of valve actuation by way of a rotating camshaft according to claim 7, wherein the bore includes a compressible material between the pushrod and the horizontal sliding arm.

9. The system of valve actuation by way of a rotating camshaft according to claim 7, further includes an oil passage through the horizontal sliding arm.

10. The system of valve actuation by way of a rotating camshaft according to claim 1, wherein the engine valve is connected to the horizontal sliding arm with a valve lock.

11. The system of valve actuation by way of a rotating camshaft according to claim 10, wherein the engine valve lock raises and lowers the valve with the horizontal sliding arm.

12. The system of valve actuation by way of a rotating camshaft according to claim 1, wherein an end of the engine valve is retained in a cavity of the horizontal sliding arm.

13. The system of valve actuation by way of a rotating camshaft according to claim 1, wherein the pushrod passes through a pushrod guide plate.

14. The system of valve actuation by way of a rotating camshaft according to claim 13, wherein the pushrod guide plate is secured by a sliding arm post.

* * * * *